US010391385B2

(12) United States Patent
McAuley

(10) Patent No.: US 10,391,385 B2
(45) Date of Patent: Aug. 27, 2019

(54) BOARD GAME APPARATUS

(71) Applicant: Lee Martin McAuley, West Sussex (GB)

(72) Inventor: Lee Martin McAuley, West Sussex (GB)

( * ) Notice: Subject to any disclaimer, the term of this patent is extended or adjusted under 35 U.S.C. 154(b) by 0 days.

(21) Appl. No.: 15/565,181

(22) PCT Filed: Apr. 29, 2016

(86) PCT No.: PCT/GB2016/051253
§ 371 (c)(1),
(2) Date: Oct. 9, 2017

(87) PCT Pub. No.: WO2016/178007
PCT Pub. Date: Nov. 10, 2016

(65) Prior Publication Data

US 2018/0093169 A1 Apr. 5, 2018

(30) Foreign Application Priority Data

May 1, 2015 (GB) ..... 1507557.5

(51) Int. Cl.
*A63F 3/00* (2006.01)
*A63F 3/04* (2006.01)

(52) U.S. Cl.
CPC ..... *A63F 3/00261* (2013.01); *A63F 3/00094* (2013.01); *A63F 2003/00255* (2013.01); *A63F 2003/00779* (2013.01); *A63F 2003/00867* (2013.01); *A63F 2003/00873* (2013.01); *A63F 2003/0418* (2013.01); *A63F 2250/481* (2013.01)

(58) Field of Classification Search
CPC ..... A63F 3/00261; A63F 3/00094; A63F 2003/00255; A63F 2003/00779; A63F 2003/00873; A63F 2003/0418; A63F 2003/481; A63F 2003/00867
USPC ..... 273/260, 261, 267, 287
See application file for complete search history.

(56) References Cited

U.S. PATENT DOCUMENTS 429,250 A 6/1890 Sperl et al.
3,588,112 A * 6/1971 Holt ..... A63F 3/00574 273/236
3,697,077 A * 10/1972 Palmer ..... A63F 3/00 273/276
3,836,151 A * 9/1974 Bowerman ..... A63F 3/027 273/282.2

(Continued)

FOREIGN PATENT DOCUMENTS

GB 2 392 849 3/2004
JP H04 5879 U 1/1992
JP 2012 100739 A 5/2012

*Primary Examiner* — Vishu K Mendiratta
(74) *Attorney, Agent, or Firm* — Bay State IP, LLC

(57) ABSTRACT

A board game which comprises of a plurality of playing pieces and a board. The board has a plurality of playing piece receptacles, with each receptacle having a playing piece support and a depression. By pressing part of the playing piece into the depression, easy removal of a playing piece can be achieved. The receptacles are formed when playing pieces are inserted in recesses that border each playing piece support. The recesses are defined at each end by a protrusion. The playing pieces can include an aesthetic dot in order to differentiate between which played used the playing piece.

14 Claims, 3 Drawing Sheets

(56) References Cited

U.S. PATENT DOCUMENTS

| | | | | | |
|---|---|---|---|---|---|
| 4,512,584 | A | * | 4/1985 | Propsom | A63F 3/00574<br>273/282.1 |
| 4,603,863 | A | * | 8/1986 | Meyer | A63F 3/00697<br>273/282.1 |
| 4,886,278 | A | * | 12/1989 | Salter | A63F 3/00<br>273/242 |
| 4,984,807 | A | * | 1/1991 | Shiryon | A63F 3/00574<br>273/262 |
| 5,286,034 | A | * | 2/1994 | Haverkate | A63B 63/00<br>273/401 |
| 5,833,240 | A | * | 11/1998 | Barbour | A63F 3/00574<br>273/282.1 |

* cited by examiner

BOARD GAME APPARATUS

CROSS REFERENCE TO RELATED APPLICATION

This application is for entry into the U.S. National Phase under § 371 for International Application No. PCT/GB2016/051253 having an international filing date of Apr. 29, 2016, and from which priority is claimed under all applicable sections of Title 35 of the United States Code including, but not limited to, Sections 120, 363, and 365(c), and which in turn claims priority under 35 USC 119 to British Patent Application No. 1507557.5 filed on May 1, 2015.

The present invention relates to a board game apparatus.

Board games are traditionally played at a table, but are also played whilst travelling or in other circumstances where the board is not always flat and or stable. Travel versions of games such as chess are known, where the playing pieces have pegs engageable in bores in the board. This is stable but not particularly convenient.

The object of the present invention is to provide an improved board game.

According to the invention there is provided a board game apparatus comprising:

- a plurality of playing pieces and
- a board having a plurality of playing piece receptcles, each receptacle having:
  - a playing piece support parallel to the board for supporting a respective on of the playing pieces parallel to the board,
  - a depression, and
  - a fulcrum between the support and the depression, the arrangement being such that pressing part of the playing piece into the depression lifts another part for lifting of the piece from the receptacle wherein:
  - each receptacle is bordered on all sides by recesses perpendicular to the board, the recesses extending below the support of the receptacle which they boarder and
  - each recess is complementary in shape to the playing pieces, and perpendicular to the board, such that playing pieces fit perpendicularly into the recesses bordering each playing piece receptacle and a respective one of the playing pieces in the playing piece receptacle, whereby these playing pieces edge the receptacle and the playing piece therein.

For playing a game such as connect the dots, the receptacles are completed when playing pieces of the same type or a different type are inserted in the recesses around each support and depression receptacle. The or both sets of playing pieces will normally be square or rectangular with the recesses defining a complementarily shaped receptacle The recesses may be defined at each end by a protrusion When playing a game, typically four square or rectangular playing pieces are places in four complementarily recesses around a support and depression to form a receptacle suitable for the placement of a fifth playing piece, the receptacle being completed by a wall of pieces in the recesses around the support and depression and complementarily to the fifth playing piece. The recesses can be of a form that the four playing pieces are placed perpendicular to the board. The fifth playing piece can then be placed parallel to the board, within the receptacle formed by the walls of the four previous playing pieces. Typically, the support and depression have a height dimension that is smaller than the length dimension of the square or rectangular playing piece. Typically, the support level is generally flat.

Typically the board is adapted such that the receptacles form a grid. In a preferred embodiment, the grid may comprise 6×6 receptacles or 8×8 receptacles. It may be envisioned that the grid may comprise 10×10 receptacles, 12×12 receptacles, 6×4 receptacles, 8×4 receptacles, 10×8 receptacles, 10×12 receptacles, or 12×8 receptacles.

Typically the depression is formed as a cut-out of the support. It may be envisioned that the depression is achieved by the support being of smaller width than the playing piece. However, the cut-out is preferably achieved by cutting the support at an angle in one corner. Preferably, the support is cut at a 20, 30, 40, 50, 60, 70 or 80 degree angle.

To help understanding of the invention, a specific embodiment thereof will now be described by way of example and with reference to the accompanying drawings, in which.

Figure 1:
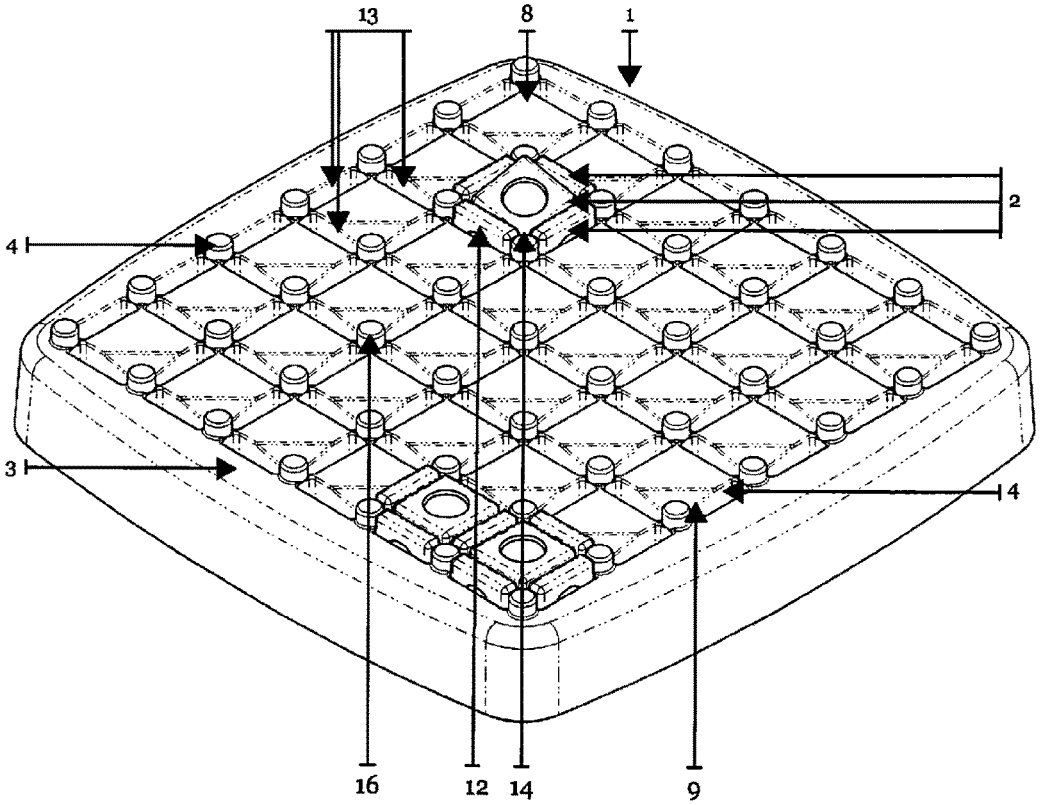
FIG. 1 is a first perspective view of the present invention.
Figure 2:
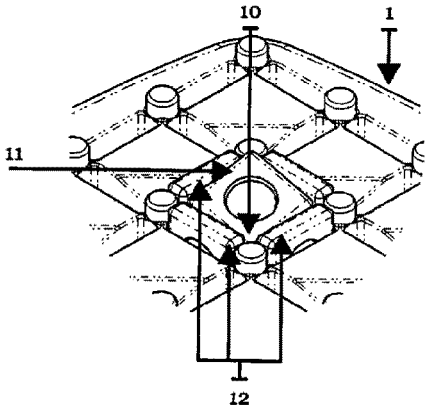
FIG. 2 is a second perspective view of the present invention.
Figure 3:
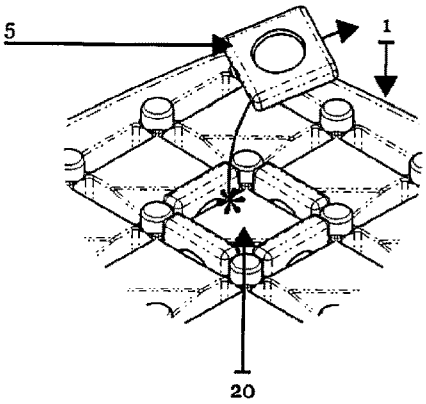
FIG. 3 is a third perspective view of the present invention.
Figure 4:
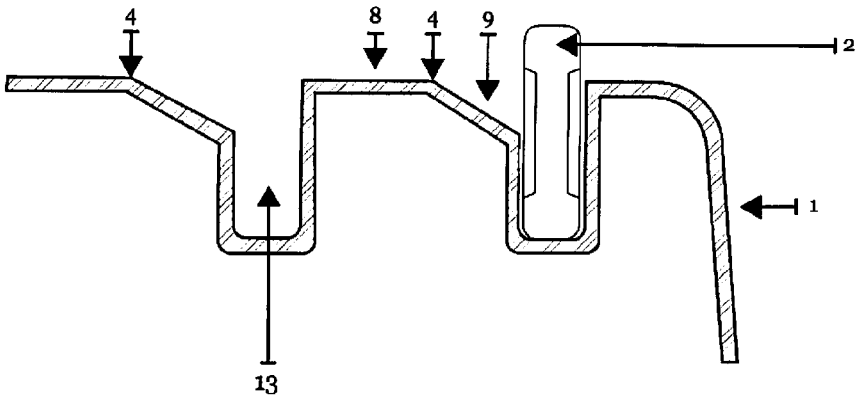
FIG. 4 is a first cross-sectional view of the present invention.
Figure 5:
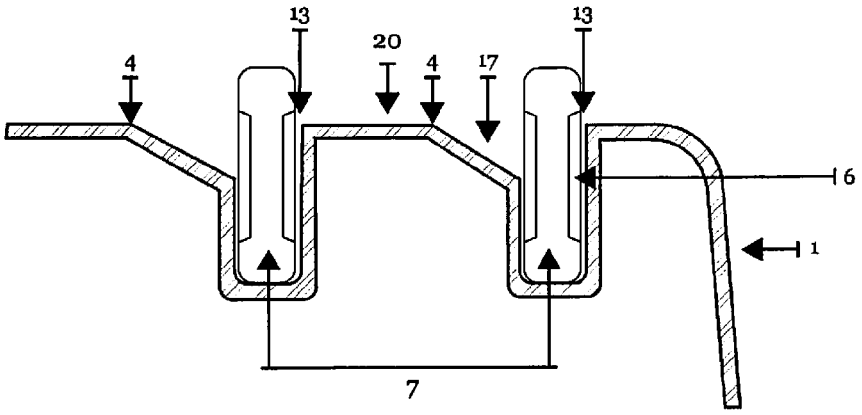
FIG. 5 is a second cross-sectional view of the present invention.
Figure 6:
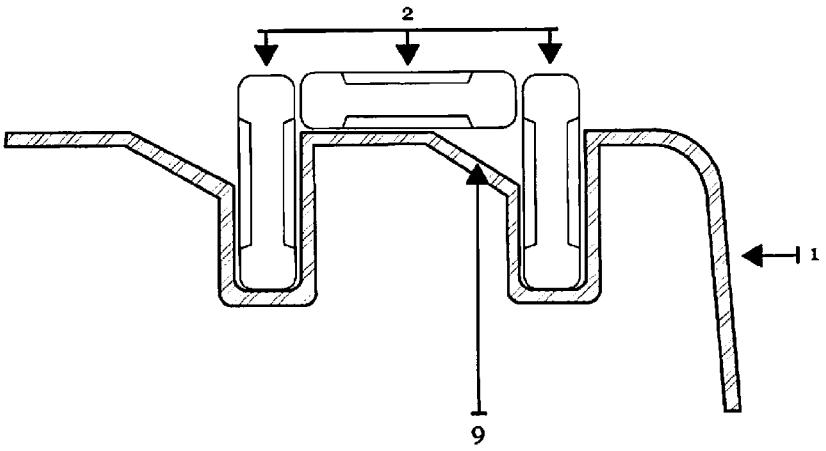
FIG. 6 is a third cross-sectional view of the present invention.
Figure 7:
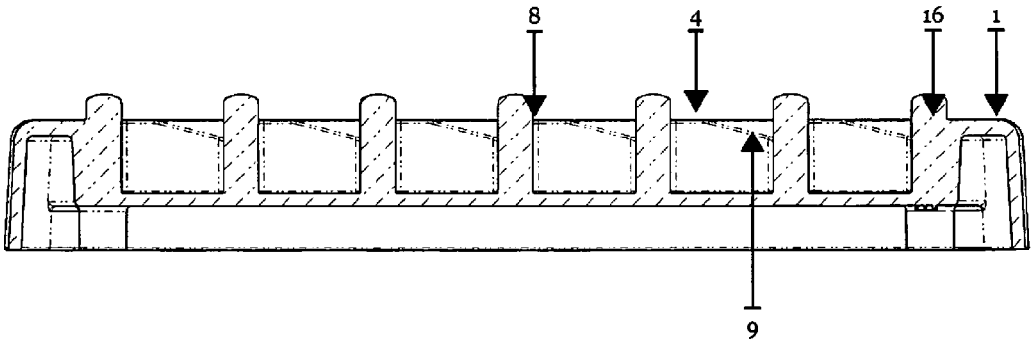
FIG. 7 is a fourth cross-sectional view of the present invention.
Figure 8:
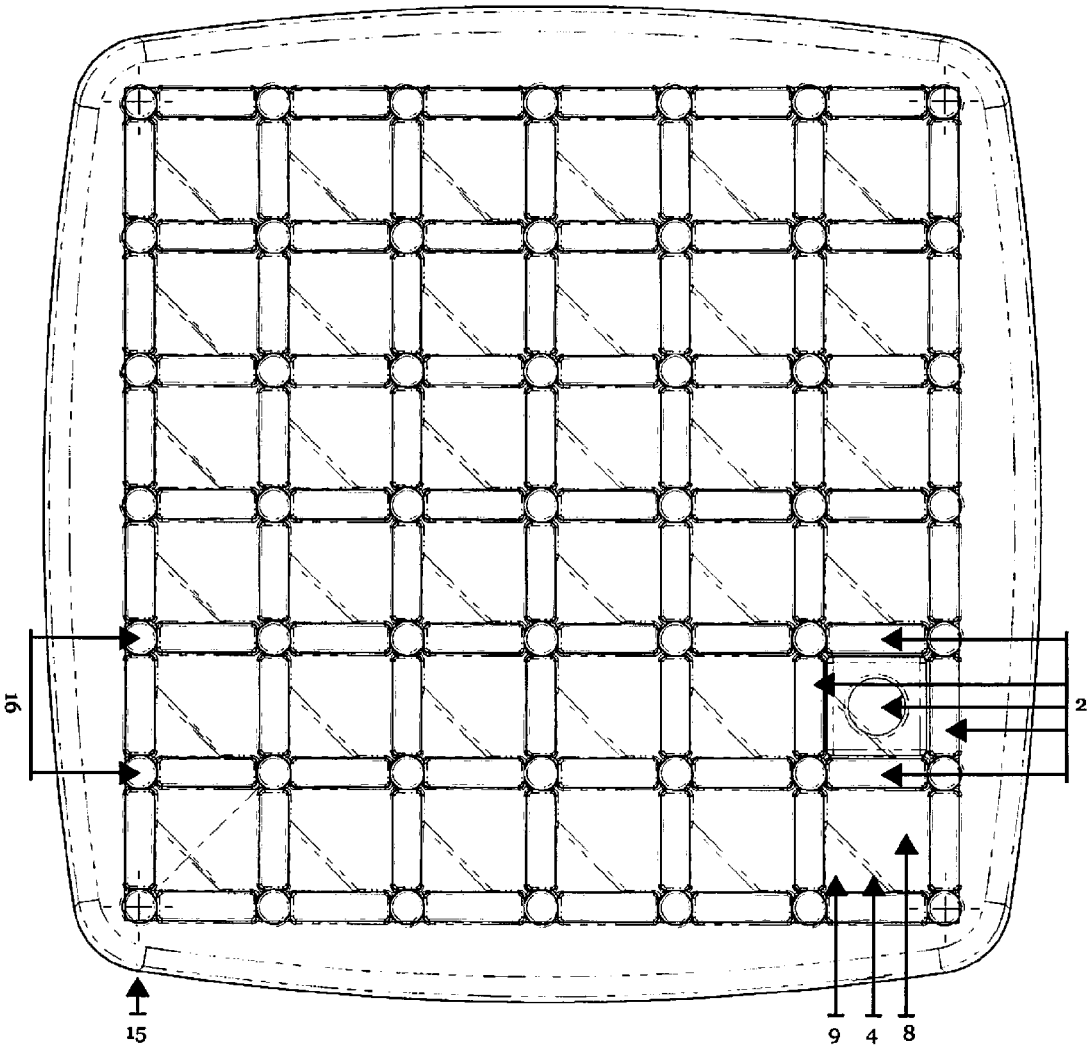
FIG. 8 is a top view of the present invention.

Referring to the figures, there is provided a board game 1 comprising a plurality of playing pieces 2 and a board 3 having a plurality of playing piece receptacles 20 each receptacle having a playing piece support 8 a depression 9 and a fulcrum 4 between the support and the depression. The arrangement being such that pressing party 10 of the playing piece into the depression lifts another part 11 for lifting 5 of the piece from the receptacle 20. For playing a game such as connect the dots, the receptacles 20 are formed when playing pieces of the same type 2 are inserted in recesses 13 around each support and depression. The playing pieces 2 will normally be square with the recesses 13 defining a complementarily shaped recess 20. The recesses 13 are defined at each end by a protrusion 16. The playing pieces can include an aesthetic dot 6 to differentiate between playing pieces.

The square playing pieces 2 are perpendicular 12 to the board when they are placed in each recess 13, but are in parallel 14 with the board when placed on the support level 8 in the receptacle 20. The board is adapted such that the receptacles 20 form a 6×6 square grid 15.

The depression 9 is formed from a cut-out by cutting the corner of the support 8 at a 30° angle 17. The support 8 has a height dimension that is smaller than the length dimension of the playing piece 2 such that when four playing pieces are placed in each complementary recess surrounding the support a receptacle 20 being defined by walls 7 is formed.

The invention is not intended to be restricted to the details of the above described embodiment.

The invention claimed is:

1. A board game apparatus comprising:

- a plurality of playing pieces and
- a board having a plurality of playing piece receptacles, each receptacle having:
  - a playing piece support parallel to the board for supporting a respective one of the playing pieces parallel to the board,
  - a depression, and
  - a fulcrum between the support and the depression, the arrangement being such that pressing part of the playing piece into the depression lifts another part for lifting of the piece from the receptacle, wherein:

each receptacle is bordered on all sides by recesses perpendicular to the board, the recesses extending below the support of the receptacle which they border, and each recess is complementary in shape to the playing pieces, and perpendicular to the board, such that playing pieces fit perpendicularly into the recesses bordering each playing piece receptacle and a respective one of the playing pieces in the playing piece receptacle, whereby these playing pieces edge the receptacle and the playing piece therein.

2. A board game apparatus as claimed in claim 1, wherein the playing pieces can be square, rectangular or circular.

3. A board game apparatus as claimed in claim 1, wherein the receptacles are permanently formed in the board.

4. A board game apparatus as claimed in claim 1, wherein the complementary recesses are perpendicular to the game board.

5. A board game apparatus as claimed in claim 1, wherein the recesses are defined at each end by a protrusion.

6. A board game apparatus as claimed in claim 1, wherein the depth of the recess, the height of the support and the thickness of the playing piece are such that when a playing piece is inserted into the recess, and a playing piece is placed upon the support, a substantially flat surface is created.

7. A board game apparatus as claimed in claim 1, wherein a playing piece can fit between the recesses that contain a playing piece.

8. A board game apparatus as claimed in claim 7, wherein the support and depression typically have a height dimension that is smaller than the length dimension of a playing piece.

9. A board game apparatus as claimed in claim 1, wherein the support level is generally flat.

10. A board game apparatus as claimed in claim 1, wherein the receptacles form a grid.

11. A board game apparatus as claimed in claim 10, wherein the grid may comprise of receptacles in the following dimensions: 6×6, 8×8, 10×10, 12×12, 6×4, 8×4, 10×8, 10×12 or 12×8.

12. A board game apparatus as claimed in claim 11, wherein the depression is formed as a cut-out from the support.

13. A board game apparatus as claimed in claim 12, wherein the depression is achieved by the support being of smaller width than the playing piece.

14. A board game apparatus as claimed in claim 13, wherein the depression is achieved by cutting the support at an angle in one corner.

* * * * *